United States Patent [19]

Kruppa et al.

[11] 4,371,350

[45] Feb. 1, 1983

[54] MARINE VESSEL WITH PROPELLER

[75] Inventors: Claus Kruppa, Berlin; Wolfgang Wührer, Ravensburg, both of Fed. Rep. of Germany

[73] Assignee: Escher Wyss GmbH, Ravensburg, Fed. Rep. of Germany

[21] Appl. No.: 191,381

[22] Filed: Sep. 29, 1980

[30] Foreign Application Priority Data

Jan. 28, 1980 [CH] Switzerland ..... 656/80

[51] Int. Cl.[3] ..... B63H 5/16

[52] U.S. Cl. ..... 440/69; 440/50

[58] Field of Search ..... 440/38, 47, 50, 68, 440/69, 70

[56] References Cited

U.S. PATENT DOCUMENTS

| | | | |
|---|---|---|---|
| 1,059,806 | 4/1913 | Yarrow | 440/69 |
| 1,543,082 | 6/1925 | Harley | 440/70 X |
| 3,082,827 | 3/1963 | Rosen | 440/50 X |
| 3,793,980 | 2/1974 | Sherman | 440/69 |

FOREIGN PATENT DOCUMENTS

| | | | |
|---|---|---|---|
| 967 | of 1897 | United Kingdom | 440/70 |

*Primary Examiner*—Sherman D. Basinger

*Attorney, Agent, or Firm*—Werner W. Kleeman

[57] ABSTRACT

A marine vessel having a propeller tunnel possessing a flow-favorable cross-sectional configuration following the flow lines of the water. Within the propeller tunnel there is mounted a propeller essentially throughout one-half of its circumference. An adjustable control plate can be extended in order to detach the flow of the water from the surface of the tunnel during rapid travel of the marine vessel. In this case, the propeller functions as a partially immersed propeller at a high rotational speed. There can be provided a control device which adjusts the control plate as a function of the rotational speed range within which the propeller operates. The propeller can be an adjustable propeller conjointly adjustable with the control plate.

7 Claims, 7 Drawing Figures

MARINE VESSEL WITH PROPELLER

BACKGROUND OF THE INVENTION

The present invention relates to a new and improved construction of a marine vessel containing at least one vessel propeller located essentially over one-half of its circumference within a tunnel formed at the body or hull of the vessel.

Such type vessel is known to the art from U.S. Pat. No. 3,793,980, granted Feb. 26, 1974. The propeller of the vessel, during slow vessel travel, should be fully immersed in the water and during rapid travel should function as a so-called semi-immersed propeller. However, the selected configuration of the tunnel is unfavorable for slow vessel travel and also for rapid vessel travel with partially-immersed propeller, so that during operation large energy losses arise due to turbulence.

SUMMARY OF THE INVENTION

Therefore, with the foregoing in mind it is a primary object of the present invention to provide an improved construction of marine vessel containing at least one propeller which is not associated with the aforementioned drawbacks and limitations of the prior art construction discussed above.

Another and more specific object of the present invention aims at constructing a marine vessel of the aforementioned type such that optimum operating conditions can be realized for the propeller both during slow and rapid travel of the vessel.

Now in order to implement these and still further objects of the invention, which will become more readily apparent as the description proceeds, the marine vessel of the present development is manifested by the features that in the lengthwise direction of the marine vessel the tunnel possesses a flow-favorable cross-sectional configuration which follows the flow lines of the water. At the transition region of the surface of the bottom of the vessel with the tunnel there is arranged an adjustable control plate. This control plate can be adjusted between a position where it tucks into or merges with the surface of the tunnel and allows for a streamline-shaped flow through the tunnel and an extended position remote from such surface where it caused detachment of the water flow from the surface of the tunnel.

Due to the inventive construction of the tunnel there is obtained a turbulence-free flow of the water through the tunnel during slow travel of the marine vessel, and the propeller is augmented in its operation by the tunnel. During rapid vessel travel, by extending the control plate, there is obtained an extensively faultless detachment of the water flow from the walls of the tunnel, specifically, also in this case with minimum turbulence and minimum flow resistance. The propeller can operate faultlessly at a higher rotational speed than a partially immersed propeller.

Preferably, the cross-sectional configuration of the tunnel, viewed in the lengthwise direction of the vessel, can possess a region or portion which merges with the surface of the bottom of the vessel. This region is bounded by a convex line at which follows a section or portion limited by a concave line. In this way there is obtained an optimum shape of the tunnel.

Viewed in a direction perpendicular to the lengthwise direction of the vessel, i.e., meaning looking, for instance from the stern 2*a* in the lengthwise direction of the vessel 1, it is possible for the tunnel to have an essentially semi-circular shaped cross-sectional configuration and it encloses the circumference of the propeller. Such construction of the tunnel produces an optimum operation of the propeller with high efficiency.

However, the tunnel also can be limited or bounded at least partially by a domed surface, whose cross-sectional configuration, in the lengthwise direction of the vessel, follows the flow lines of the water, and which is constituted by straight lines perpendicular to the lengthwise direction of the vessel. This design has the advantage of being extremely simple in construction.

According to a preferred embodiment there can be provided a control device for actuating the control plate as a function of the rotational speed range of the propeller, i.e. slow travel or rapid travel. Consequently, in all instances there is obtained a faultless actuation of the control plate, since the switching-in of the travel range, i.e. slow travel with immersed propeller and rapid travel with semi-immersed propeller, only is limited to actuation of a motor.

Preferably the propeller can be an adjustable propeller which, during operation, can have adjustable pitch angle of the vanes. A control device is provided for adjusting the vanes as a function of the rotational speed range of the propeller. The operation of the vessel with semi-immersed propeller during rapid travel requires a different, specifically, a larger adjustment angle of the vanes with respect to the plane of their rotational movement. On the other hand, during slow travel with fully immersed propeller a smaller angle of adjustment is favorable. Due to the mentioned measures there is obtained an optimum efficiency of the drive at both operating ranges, and the operation of the system can be limited merely to the actuation of a regulator of the motor.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
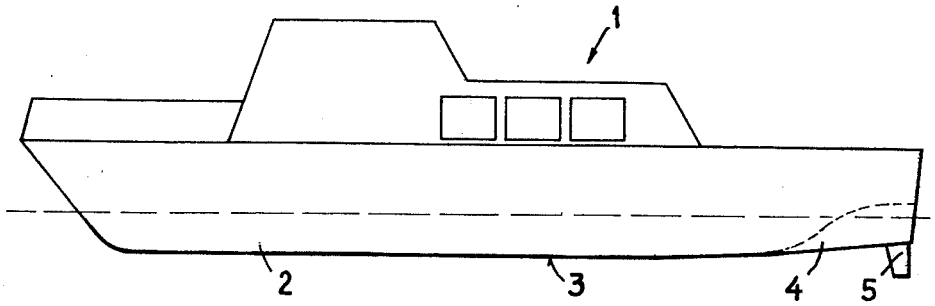
FIG. 1 is a side view of a marine vessel using the teachings of the invention.
Figure 2:
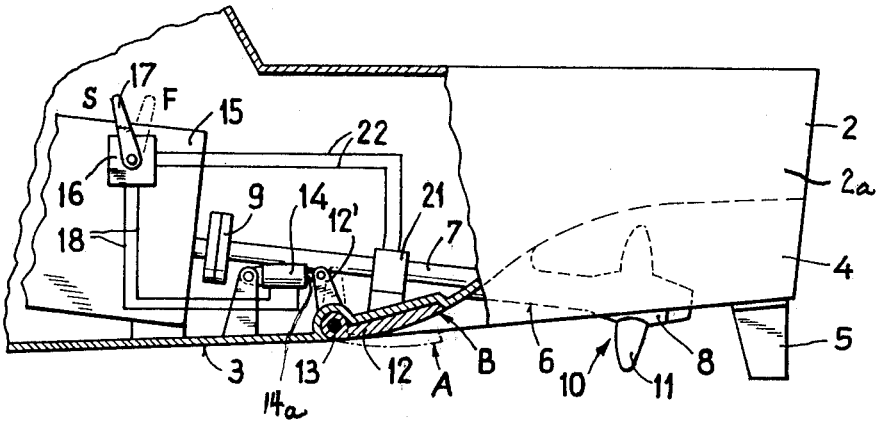
FIG. 2 is a fragmentary sectional view also showing part of the stern of the marine vessel shown in FIG. 1.

Describing now the drawings, in FIGS. 1 and 2 there has been illustrated a marine vessel 1 having a body or hull 2 with a bottom or floor 3. Within the vessel bottom or floor 3 there are formed two tunnels 4 located one behind the other, when looking at the marine vessel as shown in FIG. 1, and as particularly well seen by referring to FIG. 3. Additionally, at the stern 2a of the hull 2 there are arranged control rudders 5.

According to the showing of FIG. 2 there is located within each tunnel 4 a bearing support tube 6 for a propeller shaft 7 which carries at its end the hub 8 of a propeller 10. This propeller 10, in the arrangement under discussion, preferably can be a so-called adjustable propeller having propeller vanes 11 which can be adjusted about their axes. At the region where the vessel bottom 3 merges with the propeller tunnel 4 there is located a control plate 12. This control plate 12 or equivalent structure is rotatable about a shaft 13 can be positionally adjusted by means of a piston-and-cylinder mechanism or unit 14 between two positions. These positions are constituted by the retracted position B shown in full lines in FIG. 2 and the extended position A shown in broken lines in such FIG. 2.

As also will be apparent by reverting to the illustration of FIG. 2, the propeller shaft 7 is connected by means of a clutch or coupling 9 with a drive motor 15 equipped with a regulator 16 having an actuation lever 17. This actuation lever 17 has two positions, namely, the position S for slow travel and the position F for rapid or fast travel. Leading from the regulator 16 are two control lines 18 to the piston-and-cylinder mechanism 14, the piston rod 14a of which engages at a lever 12' of the control plate 12.

When the control lever 17 is located in the illustrated position S for slow travel, then the drive motor 15 rotates the propeller shaft 7 along with the propeller 10 at a low rotational speed, and the control plate 12 is located in the retracted position B. The same position B also will be apparent from the illustration of FIG. 4, where there have also been shown the flow lines W of the water which flows about the propeller 10. Therefore, it will be apparent that the tunnel 4 has water flowing therethrough practically free of vorticity or turbulence, and the propeller 10 operates in its fully immersed mode.

Figure 5:
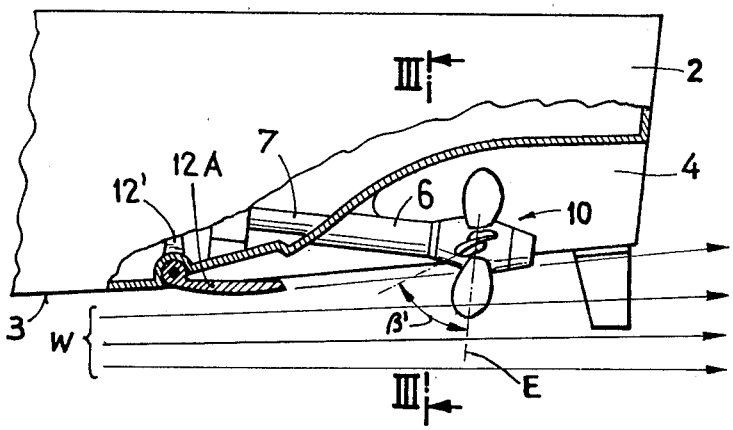
FIG. 5 is a partial sectional view, corresponding to the showing of FIG. 4, however having an extended control plate and illustrating the course of the flow lines during rapid vessel travel.

If the control lever 17 is brought into the position F of FIG. 2, then the drive motor 15 moves the propeller 10 at a high rotational speed, and at the same time by the action of the regulator 16, with the aid of the piston-and-cylinder unit 14 or any other suitable actuation device, the control plate 12 is brought into the extended position A illustrated in FIG. 5. As will be seen from this FIG. 5, the flow of the water at the end of the control plate 12 detaches from the bottom 3 of the vessel hull 2, and at the same time only about one-half of the vanes 11 of the ship's propeller 10 are immersed. Hence, the propeller 10 operates now as a semi-immersed propeller. Also in this case the water flow moves at a greater velocity, however without any appreciable turbulence losses, along the vessel 1 to the propeller 10.

Figure 3:
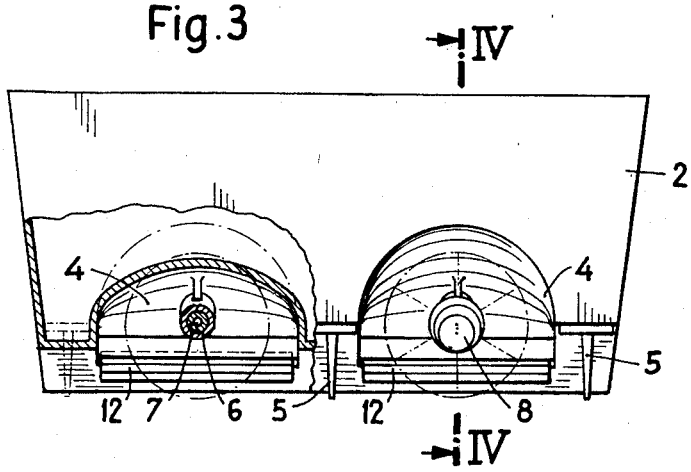
FIG. 3 is an end view looking from the right-hand side of FIG. 2 also partially in section taken along the section line III—III of FIG. 5.
Figure 4:
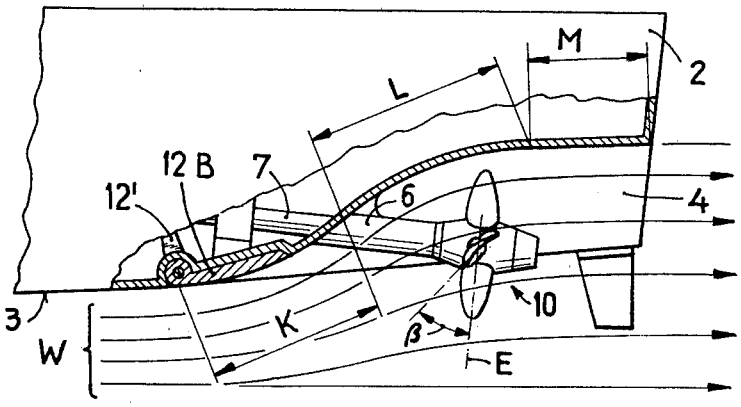
FIG. 4 is a fragmentary sectional view of the arrangement of FIG. 3, taken substantially along the line IV—IV thereof, illustrating the course of the flow lines during slow travel and retracted control plate.

As also will be particularly well seen by referring to FIG. 4, the cross-sectional configuration of the tunnel 4, viewed in sectional view along the line IV—IV of FIG. 3, possesses after the surface of the vessel floor or bottom 3 a portion or section K where the cross-section is limited or bounded by a convex line, as well as a thereafter merging section or portion L where the cross-section is limited or bounded by a concave line. At the section or portion L there can further merge a linear section or portion M.

With the heretofore described embodiment the tunnels 4, viewed perpendicular to the lengthwise direction of the vessel 1, i.e. meaning looking for instance from the stern 2a in the lengthwise direction of the vessel 1, have an essentially semi-circular shaped cross-sectional configuration, and each such tunnel 4 encloses the circumference of the related propeller 10. This construction is best seen by referring to FIG. 3.

As concerns the efficiency of the propeller, this embodiment is optimum, but under the circumstances relatively complicated.

Figure 6:
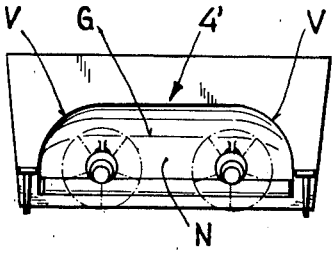
FIGS. 6 and 7 illustrate respective further embodiments of the tunnel looking from the rear of the vessel.
Figure 7:
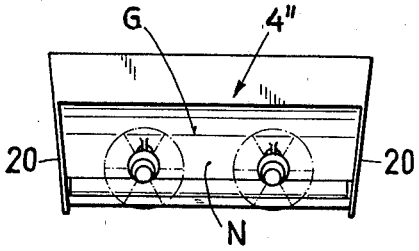

In contrast thereto, FIGS. 6 and 7 illustrate simplified embodiments of the invention, wherein there exists the advantage of a faultless operation with immersed propeller and with semi-immersed propeller.

Both embodiments of FIGS. 6 and 7 have a tunnel 4' and 4'', respectively, with at least partially are formed by a domed or arched surface N, whose cross-sectional shape, viewed in the lengthwise direction of the marine vessel 1, follows the flow lines W of the water, as for instance has been illustrated in FIGS. 4 and 5. However, the surface N is formed by straight lines G extending essentially perpendicular to the lengthwise direction of the vessel 1.

With the embodiment of FIG. 6 there merge laterally of the surface N sections or portions V having the cross-sectional configuration of one-quarter of a circle. With the embodiment of FIG. 7, which can be fabricated easiest, the domed surface N, formed by the straight lines G, extends up to the planar or flat sidewalls 20.

The inventive marine vessel 1 is particularly suitable for use with an adjustable propeller which, during operation, has adjustable pitch angle of the propeller vanes, and during rapid vessel travel with semi-immersed propeller such pitch angle can be chosen to be larger than during slow vessel travel.

Hence, in FIG. 4 the propeller 10 has been illustrated with a smaller pitch angle $\beta$, whereas during rapid vessel travel, in accordance with the illustration of FIG. 5, the pitch angle $\beta'$ with respect to the rotational plane E is larger.

The adjustment mechanism 21 for adjusting or positioning the propeller vanes 11 of the adjustable propellers are well known and do not constitute subject matter of the present invention. In fact, conventional adjustment mechanisms suitable for such purposes can be readily employed. Hence, in FIG. 2 there only has been schematically illustrated a vane adjustment or positioning device 21 which is connected by means of two control lines 22 with the regulator 16. An adjustment of the propeller vanes 11 therefore can be undertaken in this manner simultaneous with the adjustment of the control plate 12, and the adjustment of the rotational speed of the drive motor 15 can be accomplished by actuating the lever 17 of the regulator 16.

With the exemplary embodiments illustrated in the drawings, the marine vessel has two propellers, each of which has operatively associated therewith a separate tunnel or both can be arranged in a common tunnel. However, it is to be expressly understood that the marine vessel also can have a fewer or greater number of propellers, for instance one or three propellers by way of example. Equally, the number of tunnels can be different from that shown. Hence, each propeller can have its own tunnel or one tunnel can be provided for a number of propellers as previously explained.

While there are shown and described present preferred embodiments of the invention, it is to be distinctly understood that the invention is not limited thereto, but may be otherwise variously embodied and practiced within the scope of the following claims. Accordingly,

What we claim is:

1. A marine vessel comprising:

a hull having a floor portion;

a tunnel provided at the floor portion of said hull;

at least one propeller which is located essentially throughout approximately one-half of its circumference within said tunnel;

said tunnel extending in the lengthwise direction of said hull;

said tunnel possessing a flow-favorable cross-sectional configuration which follows flow lines of the water;

an adjustable control plate located forwardly of said propeller at a transition region between a surface of the floor portion and said tunnel;

means for adjusting said control plate between a first position and a second position;

said control plate when in said first position merging with the surface of said tunnel and permitting a streamlined shaped flow of the water through said tunnel so that said propeller is substantially fully immersed in the flow of water; and said control plate, when in said second position, being extended and spaced from the surface of the tunnel and causing detachment of the water flow from the surface of the tunnel so that said propeller is only semi-immersed in the flow of water.

2. The marine vessel as defined in claim 1, wherein:

said hull has a stern said tunnel, viewed from the stern of the hull, possesses an essentially semi-circular shaped configuration and encloses the circumference of the propeller.

3. The marine vessel as defined in claim 1, wherein:

said tunnel is bounded at least partially by a surface;

said surface having a cross-sectional shape which, in the lengthwise direction of the hull, follows the flow lines of the water; and said surface being formed by straight lines extending essentially perpendicular to the lengthwise direction of the hull.

4. The marine vessel as defined in claim 1, wherein:

said means for adjusting said control plate comprises a control device for actuating the control plate as a function of a rotational speed range of the propeller.

5. The marine vessel as defined in claim 1, wherein:

said propeller comprises an adjustable propeller having vanes whose pitch angle are adjustable during operation of the propeller; and control means for adjusting the vanes of the propeller as a function of the rotational speed range of the propeller.

6. The marine vessel as defined in claim 1, wherein:

said tunnel is open at a rear end thereof during operation of the marine vessel and said rear end remains unaffected in its cross-sectional area by said control plate.

7. The marine vessel as defined in claim 1, wherein:

the cross-sectional configuration of said tunnel, viewed in the lengthwise direction of the hull, possesses a portion which merges with a surface of the floor portion of the hull;

said merging portion being bounded by a convex line after which follows a further portion bounded by a concave line.

* * * * *